US005519354A

United States Patent [19]

Audy

[11] Patent Number: 5,519,354

[45] Date of Patent: May 21, 1996

[54] INTEGRATED CIRCUIT TEMPERATURE SENSOR WITH A PROGRAMMABLE OFFSET

[75] Inventor: Jonathan M. Audy, San Jose, Calif.

[73] Assignee: Analog Devices, Inc., Norwood, Mass.

[21] Appl. No.: 461,868

[22] Filed: Jun. 5, 1995

[51] Int. Cl.[6] ..... G05F 3/26

[52] U.S. Cl. ..... 327/512; 327/539; 307/651; 323/314

[58] Field of Search ..... 327/512, 513, 327/539; 307/651; 374/163, 178, 180, 183; 323/313, 312, 314

[56] References Cited

U.S. PATENT DOCUMENTS

| | | | |
|---|---|---|---|
| 4,447,784 | 5/1984 | Dobkin | 323/313 |
| 4,497,586 | 2/1985 | Nelson | 374/178 |
| 4,652,144 | 3/1987 | Günther et al. | 327/512 |
| 4,683,416 | 7/1987 | Bynum | 327/512 |
| 4,797,577 | 1/1989 | Hing | 327/513 |
| 4,902,959 | 2/1990 | Brokaw | 323/314 |
| 5,430,367 | 7/1995 | Whitlock et al. | 323/313 |
| 5,430,395 | 7/1995 | Ichimaru | 327/512 |

OTHER PUBLICATIONS

Pease, "A New Fahrenheit Temperature Sensor", *IEEE Journal of Solid-State Circuits,* vol. SC-19, No. 6, Dec. 1984, pp. 971-977.

LM35/LM35A/LM35C/LM35CA/LM35D "Precision Centigrade Temperature Sensors", *National Semi-conductor,* Data Acquition Data Book, 1993, pp. 5-12 to 5-15.

LM34/LM34A/LM34C/LM34CA/LM34D "Precision Fahrenheit Temperature Sensors", *National Semi-conductor,* Data Acquition Data Book, 1993, pp. 5-14 to 5-8.

*Primary Examiner*—Timothy P. Callahan
*Assistant Examiner*—Terry L. Englund
*Attorney, Agent, or Firm*—Koppel & Jacobs

[57] ABSTRACT

An IC temperature sensor with a programmable offset generates an output voltage $V_o$ over a desired temperature range that is a PTAT voltage $V_{PTAT}$ shifted by an offset voltage $V_{off}$. A band gap cell generates a basic PTAT voltage across a first resistor to produce a PTAT current $I_{PTAT}$. A second resistor is connected from the first resistor to a reference voltage terminal to provide voltage gain. A third resistor is connected across the base-emitter junction of a transistor which is connected from the top of the second resistor to an output terminal at which $V_o$ is generated. The transistor's base-emitter voltage provides a portion of $V_{off}$. The third resistor reduces the portion of $I_{PTAT}$ that flows through the second resistor to provide the remaining portion of $V_{off}$. A current source is positioned between the transistor's emitter and the reference voltage terminal to supply its emitter current and the current for the third resistor. The offset voltage $V_{off}$ is set by trimming the third resistor until $V_o$ equals a voltage applied to the reference voltage terminal at a lower end of the desired temperature range. The desired gain of $V_{PTAT}$ is then set by trimming the first resistor.

14 Claims, 2 Drawing Sheets

INTEGRATED CIRCUIT TEMPERATURE SENSOR WITH A PROGRAMMABLE OFFSET

BACKGROUND OF THE INVENTION

1. Field of the Invention

The present invention generally relates to integrated circuit (IC) proportional to absolute temperature (PTAT) temperature sensors, and more specifically to an IC temperature sensor with a programmable offset.

2. Description of the Related Art

The base-emitter voltage $V_{be}$ of a forward biased transistor is a linear function of absolute temperature T in degrees Kelvin (°K.), and is known to provide a stable and relatively linear temperature sensor.

$$V_{be} = \frac{kT_k}{q} \ln\left(\frac{I_c}{A_e J_s}\right) \tag{1}$$

where k is Boltzmann's constant, $T_k$ is the absolute temperature (°K.), q is the electron charge (k/q=86.17 μV/°K.), $I_c$ is the collector current, $A_e$ is the emitter area, and $J_s$ is the saturation-current density. PTAT sensors eliminate the dependence on collector current by using the difference $\Delta V_{be}$ between the base-emitter voltages $V_{be1}$ and $V_{be2}$ of two transistors that are operated at a constant ratio between their emitter-current densities to form the PTAT voltage. The emitter-current density is conventionally defined as the ratio of the collector current to the emitter size (this ignores the second order base current).

The basic PTAT voltage $\Delta V_{be}$ is given by:

$$\Delta V_{be} = V_{be1} - V_{be2} \tag{2}$$

$$\Delta V_{be} = \left(\frac{kT_k}{q}\right) \ln\left(\frac{I_{c1}A_{e2}}{I_{c2}A_{e1}}\right) \tag{3}$$

The basic PTAT voltage is amplified so that its gain, i.e. its sensitivity to changes in absolute temperature, can be calibrated to a desired value, suitably 10 mV/°K., and buffered so that a PTAT voltage can be read out without corrupting the basic PTAT voltage.

A drawback of standard PTAT sensors is that at ordinary operating temperatures for most ICs there is a large offset voltage signal. For example, if the desired operating range for an IC is 0° to 125° C. (273° to 398° K.) and the sensor has a gain of 10 mV/°K., the PTAT sensor will have an offset voltage of 2.73 V at 0° C. If the gain of the PTAT sensor is not perfectly stable, a relatively small change in the offset voltage may shift the output temperature by several degrees. To read out a temperature from 0° to 125° C., a reference voltage of precisely 2.73 V must be subtracted from the output of the PTAT sensor. Providing a reference voltage with adequate precision and stability is difficult and costly. Furthermore, PTAT sensors require relatively large supply voltages to supply the offset voltage in addition to the voltage needed to respond over the desired operating range and any head voltage needed to operate the sensor. Thus, products such as lap top computers which run off approximately 3 V supplies cannot use PTAT sensors.

Pease, "A New Fahrenheit Temperature Sensor," IEEE Journal of Solid-State Circuits, Vol. SC-19, No. 6, December 1984, pages 971–977, discloses a temperature sensor that provides an output voltage scaled proportional to the Fahrenheit temperature without subtracting a large constant offset voltage at the output. Pease generates a PTAT voltage using a conventional transistor pair and internally subtracts two base-emitter voltages to shift the PTAT voltage by a constant offset voltage. A non-inverting amplifier is used to multiply the shifted PTAT voltage by a fixed gain, e.g. 1.86, to simultaneously set the sensor's desired offset voltage, e.g. 770 mV at 77° F., and gain, e.g. 10 mV/°F. The gain is inherently calibrated by simply trimming the offset error at room temperature. In this manner, Pease effectively subtracts the offset voltage so that the sensor's output voltage is zero at 0° F.

Pease's circuit topology has several drawbacks. The shifted output voltage is produced in two separate stages: a constant offset is first subtracted from the basic PTAT voltage and then the result is multiplied by the amplifier to achieve the desired output. This increases the sensor's complexity. Because the amplifier is used to buffer the output voltage in addition to providing gain, any errors in the amplifier such as offset voltage or offset voltage drift are reflected into the output voltage signal and may cause a temperature shift. For the Fahrenheit sensor to measure 0° F., the inverting input of the amplifier must be able to go to ground potential. This type of amplifier is complex and difficult to design.

National Semiconductor Corporation produces an LM35 series of Precision Centigrade Temperature Sensors which are disclosed in their Data Acquisition Data Book, 1993, pages 5–12 to 5–15 and are the centigrade equivalent of Pease's Fahrenheit sensor. The centigrade sensors exhibit the same problems and require a minimum 4 V supply voltage.

SUMMARY OF THE INVENTION

The present invention provides a temperature sensor with an accurate programmable offset that generates an output voltage $V_o$ over a desired temperature range that is a PTAT voltage $V_{PTAT}$ shifted by an offset voltage $V_{off}$, but with a simpler design than prior temperature sensors.

This is accomplished with a band gap cell that generates a basic PTAT voltage across a first resistor to produce a PTAT current $I_{PTAT}$. A second resistor is connected from the first resistor to a reference voltage terminal to provide voltage gain. A transistor has a base that is connected between the first and second resistors, a collector that is tied to a supply voltage, and an emitter that is connected to an output terminal at which $V_o$ is generated. The transistor's base-emitter voltage provides a portion of offset voltage $v_{off}$. A third resistor is connected across the transistor's base-emitter junction, which reduces the portion of $I_{PTAT}$ that flows through the second resistor and provides the remaining portion of $V_{off}$. A current source is positioned between the transistor's emitter and the reference voltage terminal to supply its emitter current and the current for the third resistor.

The offset voltage $V_{off}$ is set by trimming the third resistor until $V_o$ equals a voltage applied to the reference voltage terminal at a lower end of the desired temperature range, e.g. 0° C. The desired gain of $V_{PTAT}$ is then set by trimming the first resistor.

For a better understanding of the invention, and to show how the same may be carried into effect, reference will now be made, by way of example, to the accompanying drawings.

DETAILED DESCRIPTION OF THE INVENTION

Figure 1:
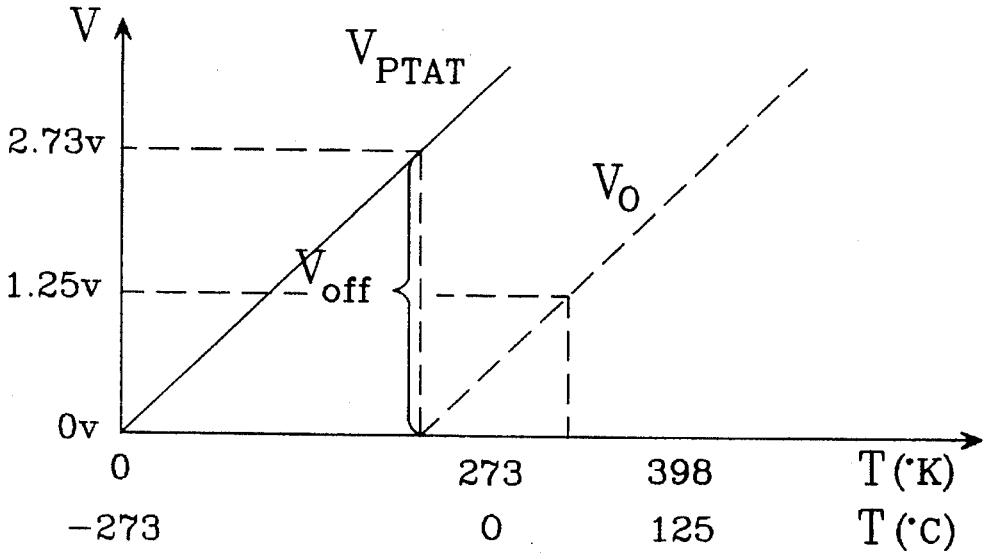
FIG. 1 is a plot of the output voltage for the sensor of the present invention versus absolute temperature.

As shown in FIG. 1, the present invention provides a temperature sensor that generates an output voltage $V_o$ that is a PTAT voltage $V_{PTAT}$ shifted by a desired offset voltage $V_{off}$ so that $V_o$ goes to the sensor's low supply, typically ground, when the temperature is at the lower end of a desired temperature range. The 0 V temperature intercept is set by programming the sensor's offset voltage and gain. This increases the sensor's accuracy, removes the need to generate and subtract a reference voltage from the output voltage, and allows the temperature sensor to operate from 0° to 125° C. with a gain of 10 mV/°C. off a single-sided supply voltage of approximately 2.7 V. This approach allows the sensor's offset voltage and gain to be adjusted to accommodate both Centigrade and Fahrenheit sensors with a wide range of operating temperatures and gains. Pease's sensor is capable of generating the same graph, but requires more complicated circuitry and at least a 4 V supply.

A programmable offset is provided by adding a single offset resistor to a conventional band gap temperature cell and by generating $V_o$ at a different point in the cell. The desired offset is programmed by trimming the offset resistor until $V_o$ equals 0 V at the desired offset temperature. The sensor's gain is programmed independently by trimming another resistor in the band gap cell. An output amplifier is preferably connected to the cell to buffer $V_o$ so that it is not effected by external loading.

This approach is simple and accurate. The offset voltage is programmed in a single stage by trimming a single resistor while the gain is controlled independently by trimming a second resistor. The output amplifier is used only to buffer $V_o$, and hence errors in the amplifier are not reflected into the output voltage. Furthermore, the amplifier is a simple one whose input does not have to be capable of going to ground potential.

Figure 2:
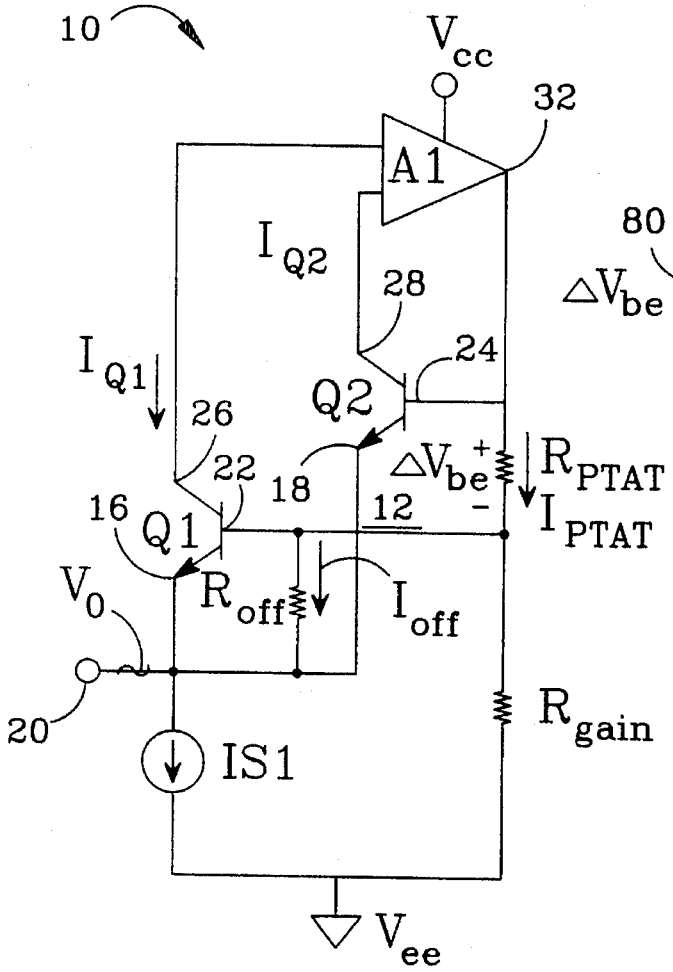
FIG. 2 is a simplified schematic diagram of a band gap temperature sensor with a programmable offset voltage in accordance with the present invention.

As shown in FIG. 2, a temperature sensor 10 that has a programmable offset in accordance with the invention includes a band gap cell 12 that provides a basic PTAT voltage $\Delta V_{be}$, and an offset resistor $R_{off}$ that selects an offset voltage so that sensor 10 produces output voltage $V_o$, where $V_o$ substantially equals the voltage at the low supply $V_{ee}$, preferably ground potential, at a lower end of a desired temperature range. Band gap cell 12 includes a pair of npn transistors Q1 and Q2 that conduct different current densities to establish the basic PTAT voltage. The ratio of their current densities is preferably set by substantially equating their collector currents $I_{Q1}$ and $I_{Q2}$, suitably 3 μA, and providing transistor Q1 with an emitter area $A_{e1}$ that is A, suitably 10, times larger than the emitter area $A_{e2}$ of transistor Q2.

The emitters 16 and 18 of transistors Q1 and Q2, respectively, are tied together at an output terminal 20. A current source IS1 is connected between output terminal 20 and ground, and supplies tail current for both transistors. Their bases 22 and 24 are connected across a resistor $R_{PTAT}$ and establish the basic PTAT voltage $\Delta V_{be}$, as described in equations 2 and 3, across a resistor $R_{PTAT}$. The PTAT voltage causes a PTAT current $I_{PTAT}$ to flow through resistor $R_{PTAT}$. A resistor $R_{gain}$ is connected from the base 22 of transistor Q1 to ground to provide gain for the basic PTAT voltage. Without the invention and ignoring the base currents of transistors Q1 and Q2, $I_{PTAT}$ would flow through resistor $R_{gain}$.

The collector currents $I_{Q1}$ and $I_{Q2}$ that flow through the collectors 26 and 28 of transistors Q1 and Q2, respectively, are input to a differential current amplifier A1 which has a current gain of suitably one hundred. The amplifier's output 32 is connected between a high voltage supply $V_{cc}$ and the base 24 of transistor Q2, and supplies $I_{PTAT}$ (ignoring the second order effects of Q2's base current) to maintain the basic PTAT voltage across resistor $R_{PTAT}$. The purpose of amplifier A1 is to make the band gap cell insensitive to changes in supply voltage $V_{cc}$. Alternately, a differential voltage amplifier could be used with pull resistors connecting its differential input and output 32 to the high supply.

In the absence of $R_{off}$, the output voltage would be taken from the top of resistor $R_{PTAT}$ and would be given by:

$$V_o = \left(1 + \frac{R_{gain}}{R_{PTAT}}\right)\frac{kT_k}{q}\ln(A) \tag{4}$$

The ratio of $R_{gain}$ to $R_{PTAT}$ would be set to select the desired gain for the temperature sensor, and the conventional output voltage $V_o$ would be PTAT, and thus would incorporate a large offset voltage.

In accordance with the invention, resistor $R_{off}$ is connected across transistor Q1's base 22 and emitter 16, and output voltage $V_o$ is read out at output terminal 20. The effect of taking the output voltage at output terminal 20 is twofold. First, the base-emitter voltage of transistor Q1 is subtracted from the PTAT voltage across resistor $R_{gain}$ and provides a portion of the desired offset $V_{off}$. Second, the output voltage $V_o$ can be reduced to 0 V at a desired temperature by reducing the voltage across current source IS1.

The effect of connecting resistor $R_{off}$ across transistor Q1's base-emitter junction is to provide a current source that sinks a portion of $I_{PTAT}$ from resistor $R_{PTAT}$, thereby reducing the portion of $I_{PTAT}$ that flows through resistor $R_{gain}$. This reduces the voltage across resistor $R_{gain}$ by the remaining portion of the desired offset $V_{off}$, which reduces $V_o$ by the same amount.

Because the base-emitter voltage of transistor Q1 is a function of temperature, connecting resistor $R_{off}$ across its base-emitter junction and moving the output has the additional effect of increasing the gain of output voltage $V_o$. This reduces the amount of gain that must be provided by the basic PTAT voltage and resistor $R_{gain}$, which in turn reduces the supply voltage $V_{cc}$ required to drive the sensor.

The characteristic equation for output voltage $V_o$ is given by the following derivation. First, the voltage across resistor $R_{gain}$ is described by:

$$V_{Rgain} = (I_{PTAT} - I_{Roff})R_{gain} \tag{5}$$

where $$I_{PTAT} = \frac{\Delta V_{be}}{R_{PTAT}} \text{ and } I_{off} = \frac{V_{be1}}{R_{off}}.$$

Substituting these relationships into equation 5 gives:

$$V_{Rgain}=\left(\frac{kT}{q}\ \frac{\ln(A)}{R_{PTAT}}-\frac{V_{be1}}{R_{off}}\right)R_{gain} \quad (6)$$

Thus, the output voltage, which is $V_{Rgain}$ shifted down by a base-emitter voltage, is given by:

$$V_o=\left(\frac{kT}{q}\ \frac{\ln(A)}{R_{PTAT}}-\frac{V_{be1}}{R_{OFF}}\right)R_{gain}-V_{be1} \quad (7)$$

The base-emitter voltage for a transistor is given by:

$$V_{be}=E_g-BT_k \quad (8)$$

where $E_g$ is the band gap voltage and B is a constant. $E_g$ is independent of processing parameters, bias-current levels, and transistor geometry, and thus provides a constant reference value of approximately 1.17 V for silicon. The constant B depends on bias current and processing, and has a typical value of 2 mV/°K.

Substituting the relation for $V_{be}$ from equation 8 into equation 7 and rearranging to separate the voltage component that is PTAT from the constant voltage offset gives:

$$V_o=\left[\frac{R_{gain}}{R_{PTAT}}\ \frac{k}{q}\ \ln(A)+B\left(1+\frac{R_{gain}}{R_{off}}\right)\right]T_k-\left(1+\frac{R_{gain}}{R_{off}}\right)E_g \quad (9)$$

Therefore, the desired offset voltage $V_{off}$ is given by:

$$V_{off}=-\left(1+\frac{R_{gain}}{R_{off}}\right)E_g \quad (10)$$

and the PTAT voltage $V_{PTAT}$ generated at output terminal 20 is:

$$V_{PTAT}=\left[\frac{R_{gain}}{R_{PTAT}}\ \frac{k}{q}\ \ln(A)+B\left(1+\frac{R_{gain}}{R_{off}}\right)\right]T_k \quad (11)$$

Thus, offset voltage $V_{off}$ is set by selecting the ratio of $R_{gain}/R_{off}$, and the gain of $V_{PTAT}$ is calibrated by selecting the resistance of $R_{PTAT}$. In practice $E_g$ does not vary appreciably, and hence $R_{gain}/R_{off}$ can be set without trimming. The slope of $V_{be}$ does vary so that $R_{PTAT}$ can be trimmed until $V_o$ equals a desired value, for example $V_o$=0.25 V at 25° C.

This configuration has the additional benefit of reducing the amount of supply voltage $V_{cc}$ that is required to drive the temperature sensor. The supply voltage has to provide approximately the voltage at base 24 of transistor Q2 for the maximum desired temperature plus a $V_{be}$ for amplifier A1. Simply providing an offset voltage at the output would not reduce this amount. However, the invention reduces the gain of the basic PTAT voltage and offsets the voltage across resistor $R_{gain}$. This reduces the voltage at base 24, and thus reduces the required supply voltage.

A good approximation is that the voltage at base 24 is a $V_{be}$ above the output voltage, and hence the supply voltage $V_{cc}$ must be at least two $V_{be}$'s above the maximum output voltage. For example, a temperature sensor with a temperature range of 0°–125° C. and a gain of 10 mV/°K. has a maximum $V_o$ of 1.25 V. A $V_{be}$ is approximately 0.414 V at 125° C. Thus, the minimum supply voltage $V_{cc}$ would be approximately 2.1 V. Therefore, a centigrade temperature sensor with a 10 mV/°C. gain and a range of 0°–125° C. would run comfortably off a 2.7 V supply.

Figure 3:
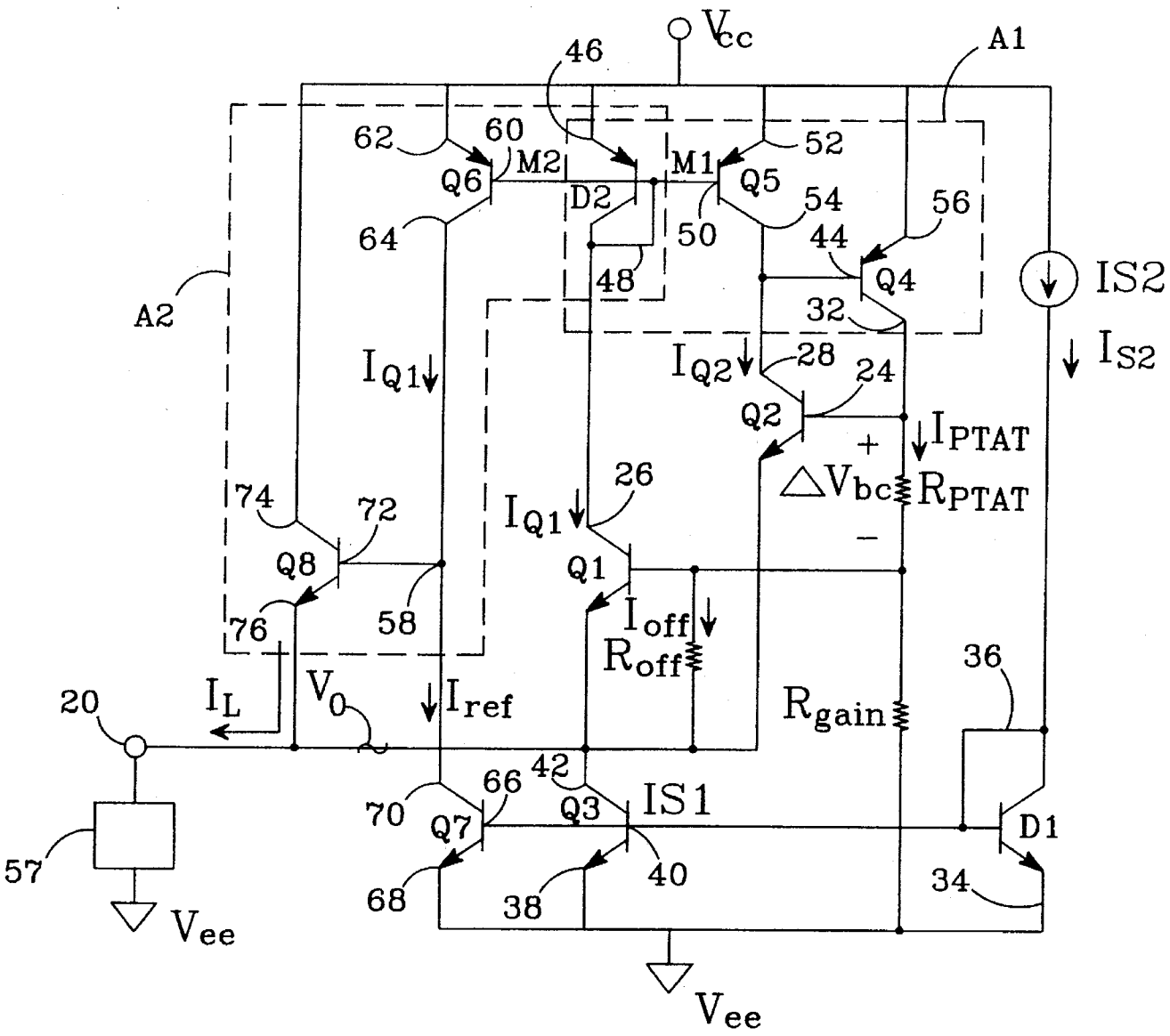
FIG. 3 is a more detailed schematic diagram of a preferred embodiment of the band gap temperature sensor shown in FIG. 2.

FIG. 3 shows a preferred temperature sensor 10 that includes the band gap cell 12 from FIG. 2 with preferred implementations of current source IS1 and differential amplifier A1, and an output amplifier A2 for buffering $V_o$.

Current source IS1 is implemented with a current source $I_{S2}$ that provides current $I_{s2}$, suitably 3 μA, which flows from the positive supply $V_{cc}$ through a diode D1 to ground. Diode D1 is implemented as a diode-connected npn transistor having an emitter 34 that is connected to ground and a base-collector 36. Another npn transistor Q3 has an emitter 38 that is connected to ground, a base 40 that is connected to base-collector 36 of diode D1, and a collector 42 that mirrors $I_{s2}$ to output terminal 20 with a fixed amount of gain. This supplies the emitter currents of transistors Q1 and Q2 and the offset current $I_{off}$ flowing through resistor $R_{off}$.

Differential current amplifier A1 includes a current mirror M1 that drives a difference current equal to $I_{Q1}-I_{Q2}$ into the base 44 of a pnp output stage transistor Q4 that amplifies the difference current to supply $I_{PTAT}$. One side of current mirror M1 includes a diode D2 that is implemented as a diode connected pnp transistor having an emitter 46 that is connected to $V_{cc}$ and a base-collector 48 that is connected to transistor Q1's collector 26. The other side of mirror M1 includes a pnp transistor Q5 having a base 50 that is connected to base-collector 48 of diode D2, an emitter 52 that is tied to $V_{cc}$, and a collector 54 that is connected to transistor Q2's collector 28 and base 44 of output stage transistor Q4. The emitter 56 of transistor Q4 is connected to $V_{cc}$ and its collector, which provides amplifier A1's output 32, is connected to the base 24 of transistor Q2.

Current mirror M1 and output stage transistor Q4 together provide a negative feedback path that stabilizes band gap cell 12 and makes it insensitive to fluctuations in the supply voltage $V_{cc}$. For example, an increase in the difference current causes an increase in $I_{PTAT}$. This in turn increases the voltage at the base 24 of transistor Q2, which increases its collector current $I_{Q2}$ and consequently reduces the difference current.

Output amplifier A2 is connected between band gap cell 12 and a load 57 such as a read out circuit, and supplies load current $I_L$ to drive load 57 in accordance with output voltage $V_o$. Without amplifier A2, transistors Q1 and Q2 would have to drive the load. Although Q1 and Q2 are capable of providing some current without affecting $V_o$, it is preferable to use amplifier A2 to provide a buffer that maintains the integrity of $V_o$ over a wide range of load conditions.

Amplifier A2 includes a current mirror M2 that mirrors collector current $I_{Q1}$ to a current node 58. Current mirror M2 shares diode D2 with mirror M1 and includes a pnp transistor Q6 having a base 60 that is connected to D2's base-collector 48, an emitter 62 that is tied to $V_{cc}$, and a collector 64 that is connected to node 58. An npn transistor Q7 having a base 66 that is connected to the base-collector 36 of diode D1, an emitter 68 tied to ground, and a collector 70, sinks a reference current $I_{ref}$ from current node 58 so that a difference current of $I_{Q1}-I_{ref}$ is supplied from node 58 to the base 72 of an output transistor Q8. This transistor has a collector 74 that is tied to $V_{cc}$, and an emitter 76 that is connected to output terminal 20. Output transistor Q8 amplifies the difference current $I_{Q1}-I_{ref}$ by its current gain β, suitably 100, to supply most of the load current $I_L$ at output terminal 20. Transistors Q1 and Q2 supply a small second order portion of the total load current $I_L$, approximately $I_L/\beta$, which is not appreciable and does not significantly effect $V_o$.

Figure 4:
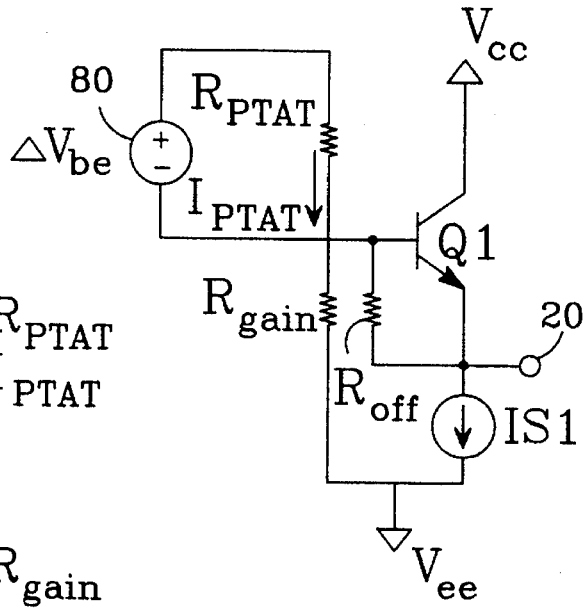
FIG. 4 is a simplified schematic diagram that illustrates the programmable offset capability of the present invention for a general PTAT voltage source.

In the preferred embodiments of temperature sensor 10 shown in FIGS. 2 and 3, transistor Q1 served a dual purpose. First, it forms part of the transistor pair Q1/Q2 that sets the basic PTAT voltage. Second, transistor Q1 together with offset resistor $R_{off}$ provides the programmable offset voltage. However, many different circuit topologies might be used to generate the basic PTAT voltage $\Delta V_{be}$. The generalized situation is shown in FIG. 4, in which a PTAT voltage source 80, such as band gap cell 12 in FIGS. 2 and 3, generates the basic PTAT voltage across resistor $R_{PTAT}$, which causes $I_{PTAT}$ to flow through resistor $R_{gain}$. The combination of transistor Q1 and resistor $R_{off}$ reduces the portion of $I_{PTAT}$ that flows through resistor $R_{gain}$ so that the output voltage $V_o$ at output terminal 20 is shifted by the desired offset.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A temperature sensor, comprising:

a reference voltage terminal;

a proportional to absolute temperature (PTAT) current source that generates a PTAT current $I_{PTAT}$ at a current node;

a first resistor $R_{gain}$ that is connected between said reference terminal and said current node and conducts a first portion of said PTAT current;

a transistor having a base that is connected to said current node, a collector, and an emitter that conducts an emitter current, and having a base-emitter voltage;

a second resistor $R_{off}$ that is connected across said transistor's base and emitter and conducts a second portion of said PTAT current;

a second current source that is connected between said emitter and said reference terminal to supply said emitter current and said second portion of said PTAT current, said first and second portions of said PTAT current flowing through resistors $R_{gain}$ and $R_{off}$, respectively, and said transistor's base-emitter voltage together producing an output voltage $V_o$ at said emitter that is a PTAT voltage $V_{PTAT}$ shifted by an offset voltage $V_{off}$, the ratio of $R_{gain}$ to $R_{off}$ being selected to set said offset voltage so that $V_o$ is substantially the same as a voltage applied to said reference terminal at a desired temperature.

2. The temperature sensor of claim 1, wherein said $V_{PTAT}$ voltage has a sensitivity to changes in absolute temperature, said PTAT current source comprising:

a PTAT voltage source that generates a basic PTAT voltage having a predetermined sensitivity; and a third resistor $R_{PTAT}$ that is connected across said voltage source to generate $I_{PTAT}$, resistor $R_{PTAT}$ being selected to set the sensitivity of $I_{PTAT}$ to changes in absolute temperature and thereby set the sensitivity of $V_{PTAT}$ at a desired value.

3. The temperature sensor of claim 1, wherein said reference voltage terminal is held at ground potential.

4. A band gap temperature sensor, comprising:

a first resistor $R_{PTAT}$;

first and second transistors having respective bases that are connected across said first resistor, collectors, and emitters that are connected together, said transistors conducting respective collector currents with different current densities which establishes a basic voltage proportional to absolute temperature (PTAT) across resistor $R_{PTAT}$ causing a PTAT current $I_{PTAT}$ to flow through resistor $R_{PTAT}$;

a reference voltage terminal;

a second resistor $R_{gain}$ that is connected between the base of the first transistor and said reference voltage terminal and conducts a first portion of $I_{PTAT}$;

a biasing current source that is connected from the emitters of said transistors to said reference voltage terminal and supplies emitter current for said transistors; and an offset current source that is connected to the base of the first transistor and sinks a second portion of $I_{PTAT}$ to set the first portion of $I_{PTAT}$ that flows through resistor $R_{gain}$, said temperature sensor responding to $I_{PTAT}$ by producing an output voltage $V_o$ at said emitters that is a PTAT voltage $V_{PTAT}$ shifted by an offset voltage $V_{off}$, resistor $R_{gain}$ being selected to set $V_{off}$ so that $V_o$ is substantially the same as a voltage applied to said reference voltage terminal at a desired temperature.

5. The temperature sensor of claim 4, wherein said offset current source comprises a third resistor $R_{off}$ that is connected across the first transistor's base and emitter and conducts said second portion of $I_{PTAT}$, the ratio of $R_{gain}$ to $R_{off}$ being selected to set $V_{off}$.

6. The temperature sensor of claim 5, further comprising:

a supply voltage terminal for receiving a supply voltage; and a differential amplifier that is connected to the supply voltage terminal, and has a differential input that is connected to the transistors' collectors and an output that is coupled to the base of the second transistor, said differential amplifier stabilizing the temperature sensor so that the basic PTAT voltage is insensitive to changes in said supply voltage.

7. The temperature sensor of claim 6, wherein said output voltage $V_o$ responds to centigrade temperatures from approximately zero degrees centigrade to approximately 125 degrees centigrade with a sensitivity of approximately 10 mV/°C., said reference and supply voltages differing by less than 3 volts.

8. The temperature sensor of claim 7, wherein said reference voltage is ground reference potential.

9. The temperature sensor of claim 6, wherein said differential amplifier comprises:

a current mirror having a reference current input that is connected to said supply voltage terminal to draw current therefrom, said differential input, and a current output, said differential input being connected to the transistors' collectors to supply their collector currents so that the current output supplies a difference current approximately equal to the difference between said collector currents;

an output stage transistor having a base that is connected to said current output and a collector-emitter circuit that amplifies said difference current to supply said PTAT current to resistor $R_{PTAT}$.

10. The temperature sensor of claim 6, further comprising:

a reference current source that generates a reference current;

an output amplifier having a differential input that is connected to said reference current source and the collector of said first transistor, and having a current output that is connected to said first transistor's emitter, said output amplifier comparing said first transistor's collector current to said reference current to supply a drive current at said current output.

11. The temperature sensor of claim 10, wherein said first and second transistors' emitters are connected at an output node, said differential and output amplifiers comprising:

a current mirror having a reference input that is connected to said first transistor's collector and supplies its collector current, first and second inputs that are connected to said second transistor's collector and said reference current source, respectively, and which conduct said first transistor's collector current, and first and second current outputs that supply the difference between the first and second transistors' collector currents and the difference between the first transistor's collector current and said reference current, respectively;

an output stage transistor having a base that is connected to said first current output and a collector-emitter circuit that supplies current to resistor $R_{PTAT}$; and a drive transistor having a base that is connected to said second current output and a collector-emitter circuit that supplies current at said output node.

12. The temperature sensor of claim 11, wherein said output voltage $V_o$ responds to centigrade temperatures from approximately zero degrees centigrade to approximately 125 degrees centigrade with a sensitivity of approximately 10 mV/°C., said reference voltage is ground potential and said supply voltage is less than 3 volts.

13. A temperature sensor, comprising:

a band gap cell that supplies a proportional to absolute temperature (PTAT) current at a current output;

a gain resistor $R_{gain}$ that is connected to said current output and conducts a first portion of the PTAT current;

a bipolar transistor having a base that is connected to said current output and an emitter; and an offset resistor that is connected from the transistor's base to its emitter to conduct a second portion of said PTAT current and thereby set the first portion of said PTAT current that flows through the gain resistor so that the transistor's emitter voltage is a PTAT voltage shifted by an offset voltage and responds over a desired temperature range, where the resistance of said offset resistor controls said offset voltage and thereby controls the value of the lower end of said temperature range.

14. The temperature sensor of claim 13, further comprising a reference voltage terminal that is connected to said gain resistor to sink said first portion of the PTAT current, the resistance of said offset resistor being set so that the transistor's emitter voltage equals a voltage applied to said reference terminal at a desired temperature in said temperature range.

* * * * *